US008407046B2

(12) United States Patent
Gao

(10) Patent No.: US 8,407,046 B2
(45) Date of Patent: Mar. 26, 2013

(54) NOISE-FEEDBACK FOR SPECTRAL ENVELOPE QUANTIZATION

(75) Inventor: Yang Gao, Mission Viejo, CA (US)

(73) Assignee: Huawei Technologies Co., Ltd., Shenzhen (CN)

( * ) Notice: Subject to any disclaimer, the term of this patent is extended or adjusted under 35 U.S.C. 154(b) by 840 days.

(21) Appl. No.: 12/554,662

(22) Filed: Sep. 4, 2009

(65) Prior Publication Data

US 2010/0063810 A1 Mar. 11, 2010

Related U.S. Application Data

(60) Provisional application No. 61/094,882, filed on Sep. 6, 2008.

(51) Int. Cl.
*G10L 19/00* (2006.01)

(52) U.S. Cl. ..... 704/230; 704/209; 704/205; 704/201; 704/200

(58) Field of Classification Search ..... 704/230, 704/209, 205, 201, 200
See application file for complete search history.

(56) References Cited

U.S. PATENT DOCUMENTS

| | | | | |
|---|---|---|---|---|
| 5,828,996 | A * | 10/1998 | Iijima et al. | 704/220 |
| 5,974,375 | A | 10/1999 | Aoyagi et al. | |
| 6,018,706 | A | 1/2000 | Huang et al. | |
| 6,629,283 | B1 | 9/2003 | Toyama | |
| 6,708,145 | B1 | 3/2004 | Liljeryd et al. | |
| 7,216,074 | B2 | 5/2007 | Malah et al. | |
| 7,328,162 | B2 | 2/2008 | Liljeryd et al. | |
| 7,359,854 | B2 | 4/2008 | Nilsson et al. | |
| 7,433,817 | B2 | 10/2008 | Kjörling et al. | |
| 7,447,631 | B2 | 11/2008 | Truman et al. | |
| 7,469,206 | B2 | 12/2008 | Kjörling et al. | |
| 7,546,237 | B2 | 6/2009 | Nongpiur et al. | |
| 2003/0093278 | A1 | 5/2003 | Malah | |
| 2004/0181397 | A1 | 9/2004 | Gao | |
| 2004/0225505 | A1 | 11/2004 | Andersen et al. | |
| 2005/0159941 | A1 | 7/2005 | Kolesnik et al. | |
| 2005/0278174 | A1 | 12/2005 | Sasaki et al. | |
| 2006/0036432 | A1 | 2/2006 | Kjorling et al. | |
| 2006/0147124 | A1 | 7/2006 | Edler et al. | |
| 2006/0271356 | A1 | 11/2006 | Vos | |
| 2007/0088558 | A1 | 4/2007 | Vos et al. | |
| 2007/0255559 | A1 * | 11/2007 | Gao et al. | 704/225 |
| 2007/0282603 | A1 | 12/2007 | Bessette | |
| 2007/0299662 | A1 | 12/2007 | Kim et al. | |
| 2008/0027711 | A1 | 1/2008 | Rajendran et al. | |
| 2008/0052066 | A1 | 2/2008 | Oshikiri et al. | |
| 2008/0052068 | A1 | 2/2008 | Aguilar et al. | |
| 2008/0091418 | A1 | 4/2008 | Laaksonen et al. | |

(Continued)

OTHER PUBLICATIONS

"G.729-based embedded variable bit-rate coder: An 8-32 kbit/s scalable wideband coder bitstream interoperable with G.729," Series G: Transmission Systems and Media, Digital Systems and Networks, Digital terminal equipments—Coding of analogue signals by methods other than PCM, International Telecommunication Union, ITU-T Recommendation G.729. May 1, 2006, 100 pages.

(Continued)

*Primary Examiner* — Qi Han
(74) *Attorney, Agent, or Firm* — Slater & Matsil, L.L.P.

(57) ABSTRACT

A method of transmitting an input audio signal is disclosed. A current spectral magnitude of the input audio signal is quantized. A quantization error of a previous spectral magnitude is fed back to influence quantization of the current spectral magnitude. The feeding back includes adaptively modifying a quantization criterion to form a modified quantization criterion. A current quantization error is minimized by using the modified quantization criterion. A quantized spectral envelope is formed based on the minimizing and the quantized spectral envelope is transmitted.

26 Claims, 6 Drawing Sheets

U.S. PATENT DOCUMENTS

| | | | | |
|---|---|---|---|---|
| 2008/0120117 | A1 | 5/2008 | Choo et al. | |
| 2008/0126081 | A1 | 5/2008 | Geiser et al. | |
| 2008/0126086 | A1 | 5/2008 | Vos et al. | |
| 2008/0154588 | A1 | 6/2008 | Gao | |
| 2008/0195383 | A1 | 8/2008 | Shlomot et al. | |
| 2008/0208572 | A1 | 8/2008 | Nongpiur et al. | |
| 2009/0254783 | A1* | 10/2009 | Hirschfeld et al. | 714/701 |
| 2010/0063802 | A1 | 3/2010 | Gao | |
| 2010/0063803 | A1 | 3/2010 | Gao | |
| 2010/0063827 | A1 | 3/2010 | Gao | |
| 2010/0070269 | A1 | 3/2010 | Gao | |
| 2010/0070270 | A1 | 3/2010 | Gao | |
| 2010/0292993 | A1* | 11/2010 | Vaillancourt et al. | 704/500 |

OTHER PUBLICATIONS

International Search Report and Written Opinion, International application No. PCT/US2009/056113, Date of mailing Oct. 22, 2009, 10 pages.

* cited by examiner

NOISE-FEEDBACK FOR SPECTRAL ENVELOPE QUANTIZATION

This patent application claims priority to U.S. Provisional Application No. 61/094,882, filed Sep. 6, 2008, and entitled "Noise-Feedback for Spectral Envelope Quantization," which application is incorporated herein by reference.

TECHNICAL FIELD

The present invention relates generally to signal encoding and, in particular embodiments, to noise feedback for spectral envelope quantization.

BACKGROUND

A spectral envelope is described by energy levels of spectral subbands in the frequency domain. In modern audio/speech transform coding technology, if an audio/speech signal is coded in the frequency domain, encoding/decoding system often includes spectral envelope coding and spectral fine structure coding. In the case of BandWidth Extension (BWE), High Band Extension (HBE), or SubBand Replica (SBR), spectral fine structure is simply generated with 0 bit or very small number of bits. Temporal envelope coding is optional, and most bits are used to quantize spectral envelope. Precise envelope coding is the first step to gain a good quality. However, precise envelope coding could require too many bits for a low bit rate coding.

Frequency domain can be defined as FFT transformed domain. It can also be in Modified Discrete Cosine Transform (MDCT) domain. One of the well-known examples including spectral envelope coding can be found in the standard ITU G.729.1. An algorithm of BWE named Time Domain Bandwidth Extension (TD-BWE) in the ITU G.729.1 also uses spectral envelope coding.

G.729.1 Encoder

A functional diagram of the encoder part is presented in FIG. 1. The encoder operates on 20 ms input superframes. By default, the input signal 101, $s_{WB}(n)$, is sampled at 16,000 Hz. Therefore, the input superframes are 320 samples long. The input signal $s_{WB}(n)$ is first split into two sub-bands using a QMF filter bank defined by the filters $H_1(z)$ and $H_2(z)$. The lower-band input signal 102, $S_{LB}^{qmf}(n)$, obtained after decimation is pre-processed by a high-pass filter $H_{h1}(z)$ with 50 Hz cut-off frequency. The resulting signal 103, $s_{LB}(n)$, is coded by the 8-12 kbit/s narrowband embedded CELP encoder. To be consistent with ITU-T Rec. G.729, the signal $s_{LB}(n)$ will also be denoted s(n). The difference 104, $d_{LB}(n)$, between s(n) and the local synthesis 105, $\hat{s}_{enh}(n)$, of the CELP encoder at 12 kbit/s is processed by the perceptual weighting filter $W_{LB}(z)$. The parameters of $W_{LB}(z)$ are derived from the quantized LP coefficients of the CELP encoder. Furthermore, the filter $W_{LB}(z)$ includes a gain compensation which guarantees the spectral continuity between the output 106, $d_{LB}^{w}(n)$, of $W_{LB}(z)$ and the higher-band input signal 107, $s_{HB}(n)$. The weighted difference $d_{LB}^{w}(n)$ is then transformed into frequency domain by MDCT. The higher-band input signal 108, $s_{HB}^{fold}(n)$, obtained after decimation and spectral folding by $(-1)^n$ is pre-processed by a low-pass filter $H_{h2}(z)$ with a 3,000 Hz cut-off frequency. The resulting signal $s_{HB}(n)$ is coded by the TDBWE encoder. The signal $s_{HB}(n)$ is also transformed into frequency domain by MDCT. The two sets of MDCT coefficients, 109, $D_{LB}^{w}(k)$, and 110, $S_{HB}(k)$, are finally coded by the TDAC encoder. In addition, some parameters are transmitted by the frame erasure concealment (FEC) encoder in order to introduce a parameter-level redundancy in the bitstream. This redundancy allows for an improved quality in the presence of erased superframes.

TDBWE Encoder

The TDBWE encoder is illustrated in FIG. 2. The TDBWE encoder extracts a fairly coarse parametric description from the pre-processed and down-sampled higher-band signal 201, $s_{HB}(n)$. This parametric description comprises time envelope 202 and frequency envelope 203 parameters. A summarized description of envelope computations and the parameter quantization scheme will be given later.

The 20 ms input speech superframe $s_{HB}(n)$ (with a 8 kHz sampling frequency) is subdivided into 16 segments of length 1.25 ms each, i.e.,with each segment comprising 10 samples. The 16 time envelope parameters 102, $T_{env}(i)$, i=0, . . . , 15, are computed as logarithmic subframe energies before the quantization. For the computation of the 12 frequency envelope parameters 203, $F_{env}(j)$, j=0, . . . , 11, the signal 201, $s_{HB}(n)$, is windowed by a slightly asymmetric analysis window. The maximum of the window $w_F(n)$ is centered on the second 10 ms frame of the current superframe. The window $w_F(n)$ is constructed such that the frequency envelope computation has a lookahead of 16 samples (2 ms) and a lookback of 32 samples (4 ms). The windowed signal $s_{HB}^{w}(n)$ is transformed by FFT. Finally, the frequency envelope parameter set is calculated as logarithmic weighted sub-band energies for 12 evenly spaced and equally wide overlapping sub-bands in the FFT domain. The j-th sub-band starts at the FFT bin of index 2j and spans a bandwidth of 3 FFT bins.

TDAC Encoder

The Time Domain Aliasing Cancellation (TDAC) encoder is illustrated in FIG. 3. The TDAC encoder represents jointly two split MDCT spectra 301, $D_{LB}^{w}(k)$, and 302, $S_{HB}(k)$, by a gain-shape vector quantization. In other words, the joint spectrum 303, Y(k), is constructed by combining the two split MDCT spectra 301, $D_{LB}^{w}(k)$, and 302, $S_{HB}(k)$. The joint spectrum is divided into many sub-bands. The gains in each sub-band define the spectral envelope. The shape of each sub-band is encoded by embedded spherical vector quantization using trained permutation codes. The gain-shape of $S_{HB}(k)$ represents a true spectral envelope in a second band.

The MDCT coefficients of Y(k) in 0-7,000 Hz band are split into 18 sub-bands. The j-th sub-band comprises nb_coef(j) coefficients of Y(k) with sb_bound(j)≦k<sb_bound(j+1). The first 17 sub-bands comprise 16 coefficients (400 Hz), and the last sub-band comprises 8 coefficients (200 Hz). The spectral envelope is defined as the root mean square (rms) 304 in log domain of the 18 sub-bands:

$$\log_\mathrm{rms}(j) = \frac{1}{2}\log_2\left[\frac{1}{\mathrm{nb_coef}(j)}\sum_{k=sb_bound(j)}^{sb_bound(j+1)-1} Y(k)^2 + \varepsilon_{rms}\right], \quad j = 0, \ldots, 17 \tag{1}$$

where $\epsilon_{rms}=2^{-24}$. The gain-shape defined by equation (1) in the second half number of the 18 sub-bands represents the true spectral envelope of $S_{HB}(k)$. Each spectral envelope gain is quantized with 5 bits by uniform scalar quantization, and the resulting quantization indices are coded using a two-mode binary encoder. The 5-bit quantization consists in computing the indices 305, rms_index(j), j=0, . . . , 17, as follows:

$$\text{rms_index}(j) = \text{round}\left(\frac{1}{2}\log_\text{rms}(j)\right) \quad (2)$$

with the restriction:

$$-11 \leq \text{rms_index}(j) \leq +20$$

For example, the indices are limited between, and including −11 and +20 (with 32 possible values). The resulting quantized full-band envelope is then divided into two subvectors:

a lower-band spectral envelope: (rms_index(0), rms_index(1), . . . , rms_index(9)) and a higher-band spectral envelope:

(rms_index(10), rms_index(11), . . . , rms_index(17)).

These two subvectors are coded separately using a two-mode lossless encoder, which switches adaptively between differential Huffman coding (mode 0) and direct natural binary coding (mode 1). Differential Huffman coding is used to minimize the average number of bits, whereas a direct natural binary coding is used to limit the worst-case number of bits as well as to correctly encode the envelope of signals, which are saturated by differential Huffman coding (e.g., sinusoids). One bit is used to indicate the selected mode to the spectral envelope decoder.

TDBWE Decoder

FIG. 4 illustrates the concept of the TDBWE decoder module. The TDBWE receives parameters, which are computed by the parameter extraction procedure, and are used to shape an artificially generated excitation signal 402, $\hat{s}_{HB}^{exc}(n)$, according to desired time and frequency envelopes 408, $\hat{T}_{env}(i)$, and 409, $\hat{F}_{env}(j)$. This is followed by a time-domain post-processing procedure. The quantized parameter set consists of the value $\hat{M}_T$ and the following vectors: $\hat{T}_{env,1}$, $\hat{T}_{env,2}$, $\hat{F}_{env,1}$, $\hat{F}_{env,2}$, and $\hat{F}_{env,3}$. The quantized mean time envelope $M_T$ is used to reconstruct the time envelope and the frequency envelope parameters from the individual vector components, i.e.:

$$\hat{T}_{env}(i)=\hat{T}_{env}^{M}(i)+\hat{M}_T,\ i=0, \ldots, 15 \quad (3)$$

and $$\hat{F}_{env}(j)=\hat{F}_{env}^{M}(j)+\hat{M}_T,\ j=0, \ldots, 11 \quad (4)$$

The decoded frequency envelope parameters $\hat{F}_{env}(j)$ with j=0, . . . , 11 are representative for the second 10 ms frame within the 20 ms superframe. The first 10 ms frame is covered by parameter interpolation between the current parameter set and the parameter set $\hat{F}_{env,old}(j)$ from the preceding superframe:

$$\hat{F}_{env,int}(j) = \frac{1}{2}\left(\hat{F}_{env,old}(j) + \hat{F}_{env}(j)\right), \quad j = 0, \ldots, 11 \quad (5)$$

The superframe of 403, $\hat{s}_{HB}^{T}(n)$, is analyzed twice per superframe. A filter-bank equalizer is designed such that its individual channels match the sub-band division to realize the frequency envelope shaping with proper gain for each channel. The respective frequency responses for the filter-bank design are depicted in FIG. 5.

TDAC Decoder

The TDAC decoder (depicted in FIG. 6) is simply the inverse operation of the TDAC encoder. The higher-band spectral envelope is decoded first. The bit indicating the selected coding mode at the encoder may be: 0→differential Huffman coding, 1→natural binary coding. If mode 0 is selected, 5 bits are decoded to obtain an index rms_index(10) in [−11, +20]. Then, the Huffman codes associated with the differential indices diff_index(j), j=11, . . . , 17, are decoded. The index 601, rms_index(j), j=11, . . . , 17, is reconstructed as follows:

$$\text{rms_index}(j)=\text{rms_index}(j-1)+\text{diff_index}(j) \quad (6)$$

If mode 1 is selected, rms_index(j), j=10, . . . , 17, is obtained in [−11, +20] by decoding 8×5 bits. If the number of bits is not sufficient to decode the higher-band spectral envelope completely, the decoded indices rms_index(j) are kept to allow partial level-adjustment of the decoded higher-band spectrum. The bits related to the lower band, i.e., rms_index (j), j=0, . . . , 9, are decoded in a similar way as in the higher band, including one bit to select mode 0 or 1. The decoded indices are combined into a single vector [rms_index(0) rms_index(1) . . . rms_index(17)], which represents the reconstructed spectral envelope in log domain. The envelope 602 is converted into the linear domain as follows:

$$\text{rms_}q(j)=2^{1/2\ \text{rms_index}(j)} \quad (7)$$

SUMMARY

Embodiments of the present invention generally relate to the field of speech/audio transform coding. In particular, embodiments relate to the field of low bit rate speech/audio transform coding and specifically to applications in which ITU G.729.1 and/or G.718 super-wideband extension are involved.

One embodiment provides a method of quantizing a spectral envelope by using a Noise-Feedback solution. The spectral envelope has a plurality of spectral magnitudes of spectral subbands. The spectral magnitudes are quantized one by one in scalar quantization. The quantization error of previous magnitude is fed back to influence the quantization of current magnitude by adaptively modifying the quantization criterion. The current quantization error is minimized by using the modified quantization criterion.

In one example, the scalar quantization can be the usual direct scalar quantization or the indirect scalar quantization such as differential coding or Huffman coding, in Log domain or Linear domain.

In another example, the initial quantization error of current magnitude can be defined as $Er(i)=M_{q2}(i)-M(i)$, where M(i) is the current reference magnitude and $M_{q2}(i)$ is the current quantized one. The initial quantization error of previous magnitude is $Er(i-1)=M_{q2}(i-1)-M(i-1)$, where M(i−1) is the previous reference magnitude and $M_{q2}(i-1)$ is the previous quantized one. The quantization error minimization of first magnitude can be expressed as $\text{MIN}\{|M_{q2}(\mathbf{0})-M(\mathbf{0})|\}$, where M(0) is the first reference magnitude and $M_{q2}(\mathbf{0})$ is the first quantized one. The quantization error minimization of current magnitude can be modified as $\text{MIN}\{|M_{q2}(i)-M(i)-\alpha\cdot Er(i-1)|\}$, where M(i) is the current reference magnitude, $M_{q2}(i)$ is the current quantized one, Er(i−1) is the quantization error of previous magnitude, and α is a constant (0<α<1) to control how much error noise needs to be fed back from the quantization error Er(i−1) of previous magnitude.

In another example, the overall energy or the average magnitude of the quantized spectral envelope can be adjusted or normalized in the time domain or frequency domain.

In one example, the reference magnitudes can be also indirectly expressed as M(i)=maxVal−log Gains(i), where maxVal is the maximum spectral magnitude and log Gains(i) is the spectral magnitude in Log domain. The quantized one can be expressed as $M_{q2}(i)=Index(i)\cdot Step$, Index(i) is the quantization index for each magnitude and Step can be related to the maximum spectral magnitude maxVal in such way as Step=maxVal/4, where if Step>1.2, Step=1.2.

In another example, the over all energy of the quantized spectral envelope does not need to be adjusted or normalized if $\alpha$ is small.

In another example, the control coefficient $\alpha$ is about 0.5.

BRIEF DESCRIPTION OF THE DRAWINGS

For a more complete understanding of the present disclosure, and advantages thereof, reference is now made to the following descriptions taken in conjunction with the accompanying drawing, in which.

DETAILED DESCRIPTION OF ILLUSTRATIVE EMBODIMENTS

Figure 1:
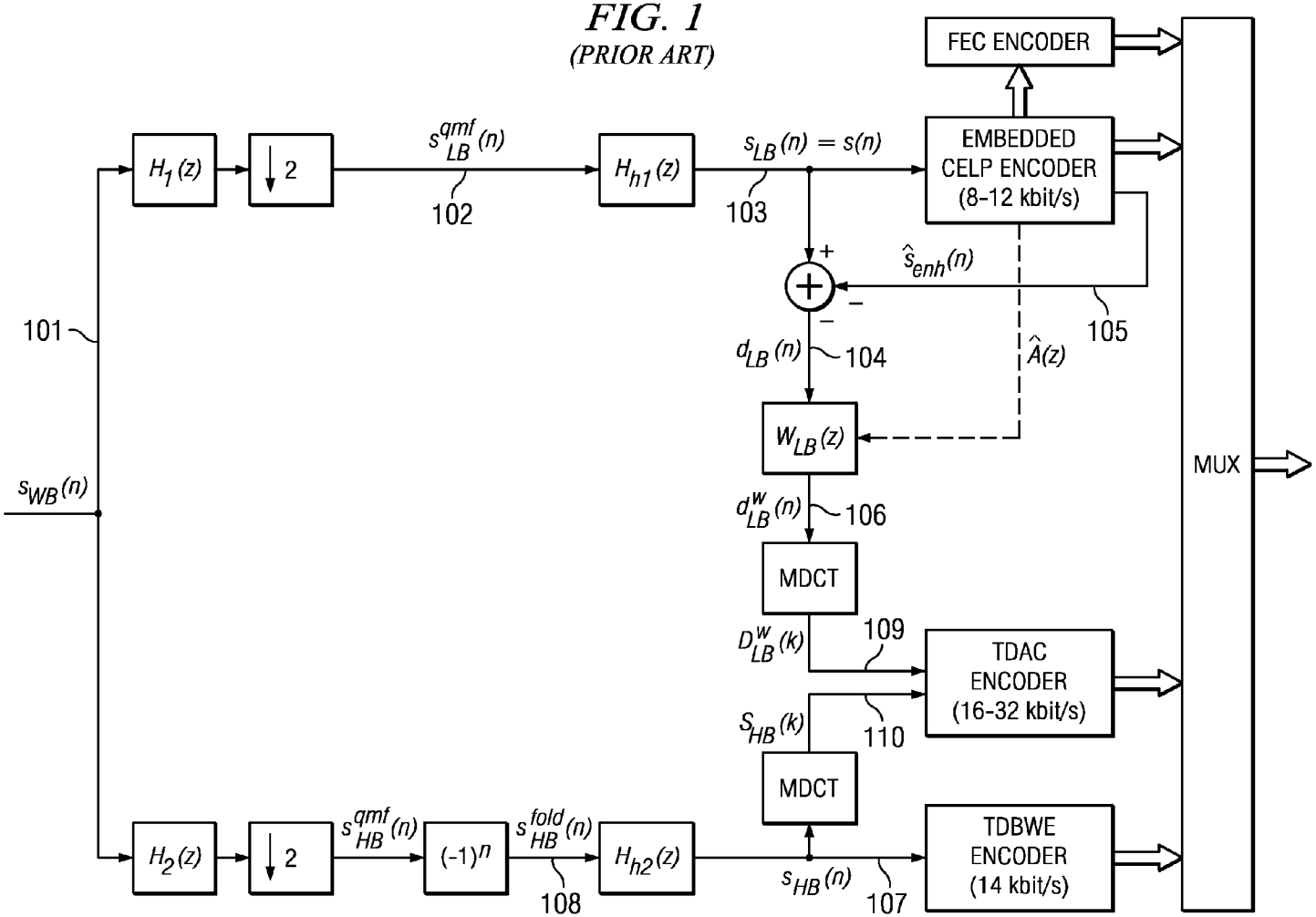
FIG. 1 (PRIOR ART)
FIG. 1 illustrates a high-level block diagram of the G.729.1 encoder.
Figure 2:
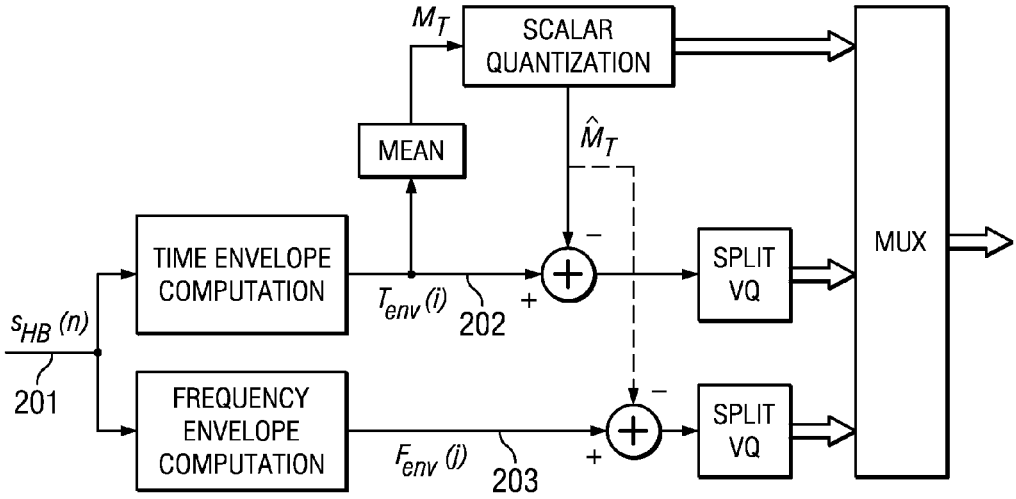
FIG. 2 (PRIOR ART)
FIG. 2 illustrates high-level block diagram of the TDBWE encoder for G.729.1.
Figure 3:
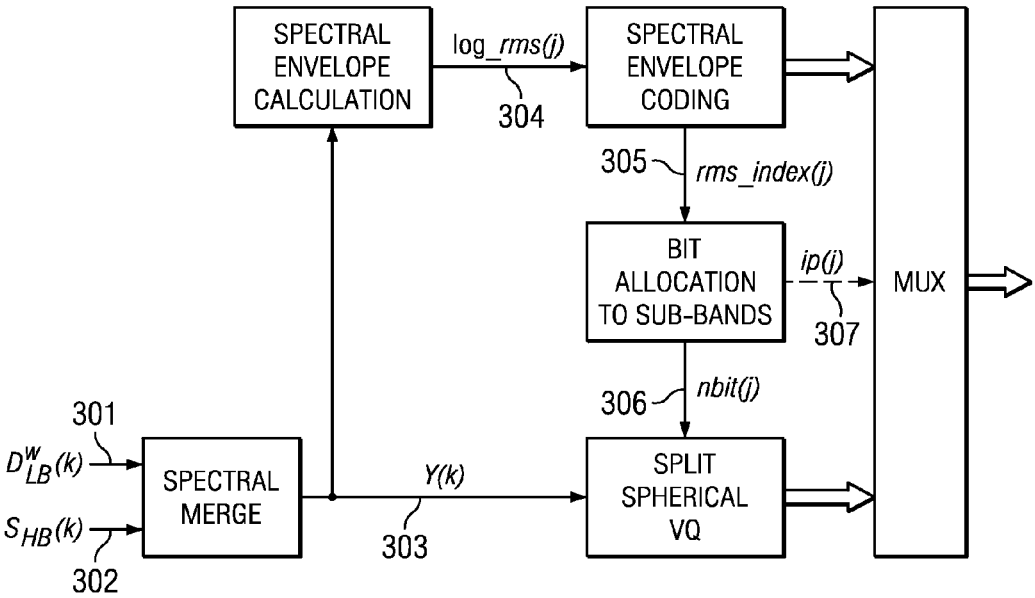
FIG. 3 (PRIOR ART)
FIG. 3 illustrates a high-level block diagram of the TDAC encoder for G.729.1.
Figure 4:
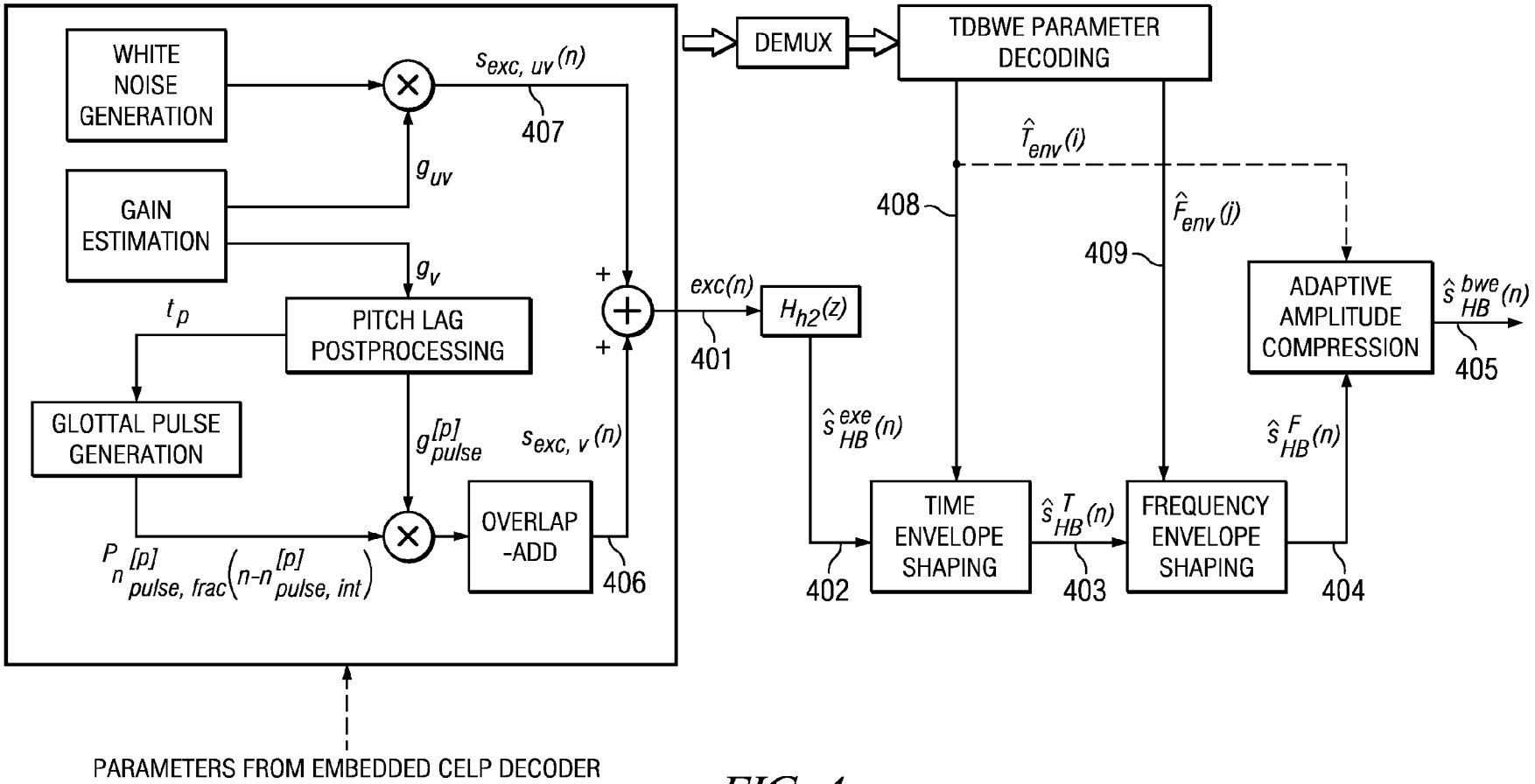
FIG. 4 (PRIOR ART)
FIG. 4 illustrates a high-level block diagram of the TDBWE decoder for G.729.1.
Figure 5:
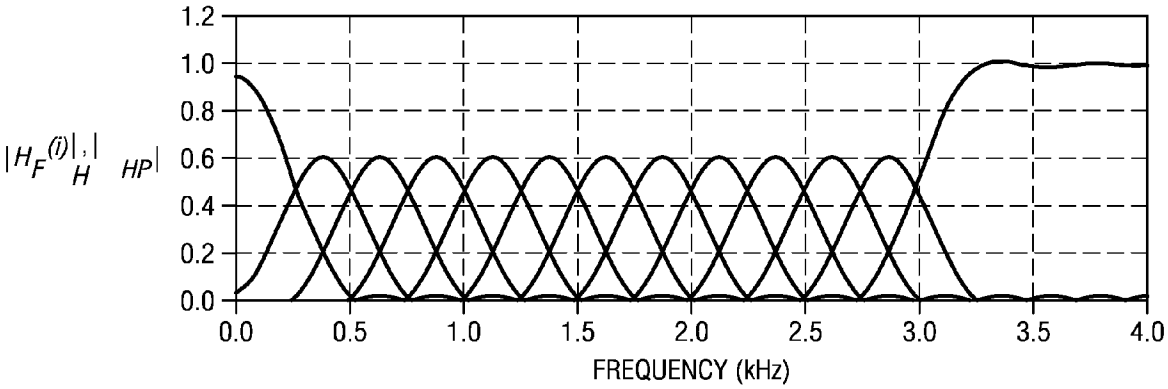
FIG. 5 (PRIOR ART)
FIG. 5 illustrates a filter-bank design for the frequency envelope shaping for G.729.1.
Figure 6:
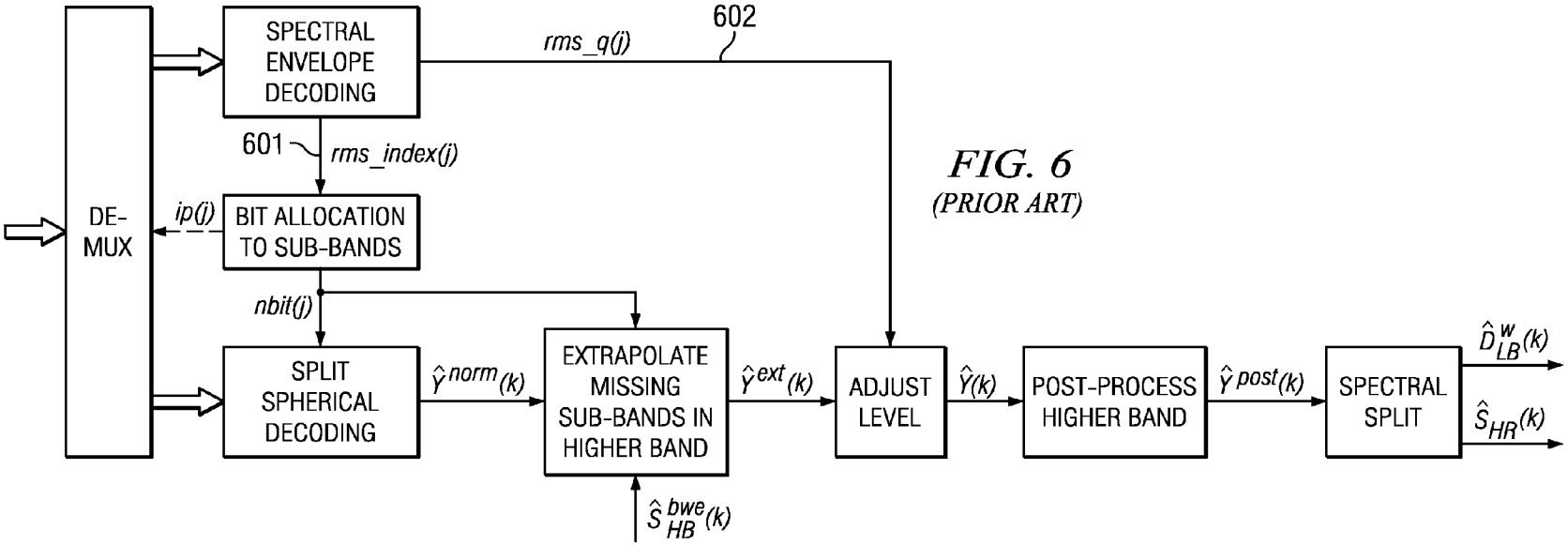
FIG. 6 (PRIOR ART)
FIG. 6 illustrates a block diagram of the TDAC decoder for G.729.1.
Figure 7:
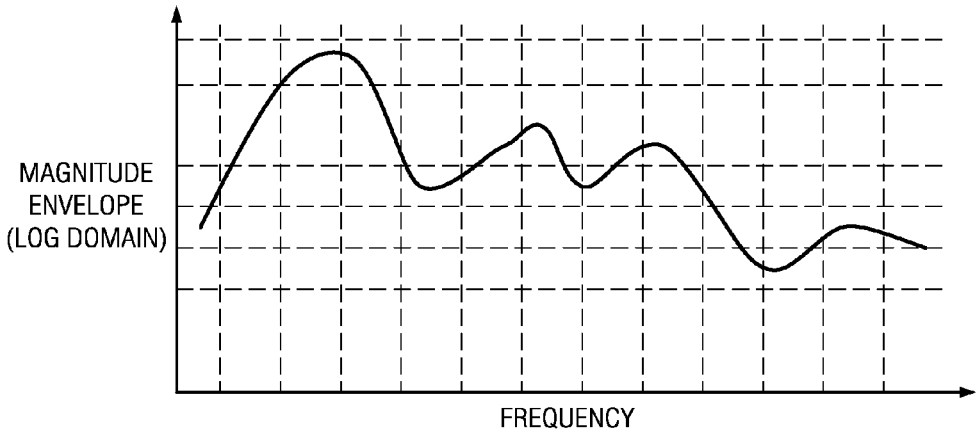
FIG. 7 illustrates a graph showing a traditional quantization.

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

A spectral envelope is described by energy levels of spectral subbands in frequency domain. In modern audio/speech transform coding technology, encoding/decoding system often includes spectral envelope coding and spectral fine structure coding. In case of a BWE algorithm, spectral envelope coding helps achieve good quality; precise envelope coding with usual approach could require too many bits for a low bit rate coding. Embodiments of this invention propose a Noise-Feedback solution which can improve spectral envelope quantization precision while maintaining low bit rate, low complexity and low memory requirement.

Spectral envelope is described by energy levels of spectral subbands in frequency domain. In modern audio/speech coding technology, if audio/speech signal is coded in frequency domain, encoding/decoding system often includes spectral envelope coding and spectral fine structure coding. In the case of BandWidth Extension (BWE), High Band Extension (HBE), or SubBand Replica (SBR), spectral fine structure is simply generated with 0 bit or very small number of bits. Temporal envelope coding is optional, and most bits are used to quantize spectral envelope. Precise envelope coding is the first step to gain good quality. However, precise envelope coding with a usual approach could require too many bits for a low bit rate coding. Embodiments of the invention utilize a Noise-Feedback solution, which can improve the spectral envelope quantization precision while maintaining low bit rate, low complexity and low memory requirement.

The spectral envelope can be defined in Linear domain or Log domain. Suppose a spectral envelope is quantized in Log domain with uniform scalar quantization, a similar definition as in equation (1) can be used to express spectral magnitudes forming spectral envelope. The scalar quantization can be usual direct scalar quantization or indirect scalar quantization such as differential coding or Huffman coding in Log domain or Linear domain. The unquantized original envelope magnitude coefficients are noted as:

$$M(i),\ i=0,1,\ldots,N_{sb}-1; \tag{8}$$

where $N_{sb}$ is the total number of subbands. This number may sometimes be pretty big. The quantized envelope coefficients are noted as:

$$M_{q1}(i),\ i=0,1,\ldots,N_{sb}-1. \tag{9}$$

These quantized envelope coefficients are selected from predetermined table or rule, which is available in both encoder and decoder. The traditional quantization criteria is simply to minimize the direct error between the original and the quantized:

$$\mathrm{MIN}\{|M(i)-M_{q1}(i)|\},\ i=0,1,\ldots,N_{sb}-1. \tag{10}$$

This traditional quantization criteria gives the best energy matching, but it does not generate the best relative shape of spectral envelope, although, perceptually, the relative shape of spectral envelope may be the most important. If the shape is correct, the overall energy can be matched in other ways or with a few extra bits.

For example, assuming the quantization table contains integers, the unquantized coefficients are {3.4, 4.6, 5.4, . . . }. It will be quantized to {3, 5, 5, . . . }. This quantized result gives the best energy matching. However, we can see that {3, 4, 5, . . . } has a better shape matching than {3, 5, 5, . . . }. A method of automatically generating better shape matching will be proposed.

Since the scalar quantization in encoder is processed one by one, the previously quantized error can be used to improve the current quantization. Suppose M(i) is quantized from (i=0) to ($i=N_{sb}-1$), the new quantized coefficients will be:

$$M_{q2}(i),\ i=0,1,\ldots,N_{sb}-1. \tag{11}$$

When i=0, the first one M(0) is directly quantized by minimizing $|M_{q2}(\mathbf{0})-M(\mathbf{0})|$. The error is noted as:

$$Er(0)=M_{q2}(0)-M(0). \tag{12}$$

For i>0, the quantization error is expressed as:

$$Er(i)=M_{q2}(i)-M(i),\ i=1,\ldots,N_{sb}-1. \tag{13}$$

Suppose the previous coefficient at (i−1) is already quantized and the known quantization error is:

$$Er(i-1)-M_{q2}(i-1)-M(i-1). \tag{14}$$

During the current quantization of M(i), the error minimization criteria can be modified to minimize the following expression:

$$\mathrm{MIN}\{|M_{q2}(i)-M(i)-\alpha\cdot Er(i-1)|\}, \tag{15}$$

where $\alpha$ is a constant ($0<\alpha<1$). It is observed that when $\alpha=0$, the above criteria becomes the traditional criteria. When $\alpha>0$, the above criteria generates better shape matching, and the greater the constant $\alpha$is, the stronger shape matching correction will be resulted. The small overall energy mismatching can be compensated in another way (such as post temporal shaping) or with only 1 or 2 bits by minimizing the following error;

$$\text{Error} = \sum_{i=0}^{N_{sb}-1} [M(i) - (M_{q2}(i) + E_m)]^2. \tag{16}$$

The best average error correction would be:

$$E_m = \frac{1}{N_{sb}} \sum_{i=0}^{N_{sb}-1} [M(i) - M_{q2}(i)], \tag{17}$$

where $E_m$ will be quantized with very few bits and added to $M_{q2}(i)$. Another possible small correction is to minimize the following equation:

$$\text{Error} = \sum_{i=0}^{N_{sb}-1} [M(i) - F_m \cdot M_{q2}(i)]^2. \tag{18}$$

Figure 8:
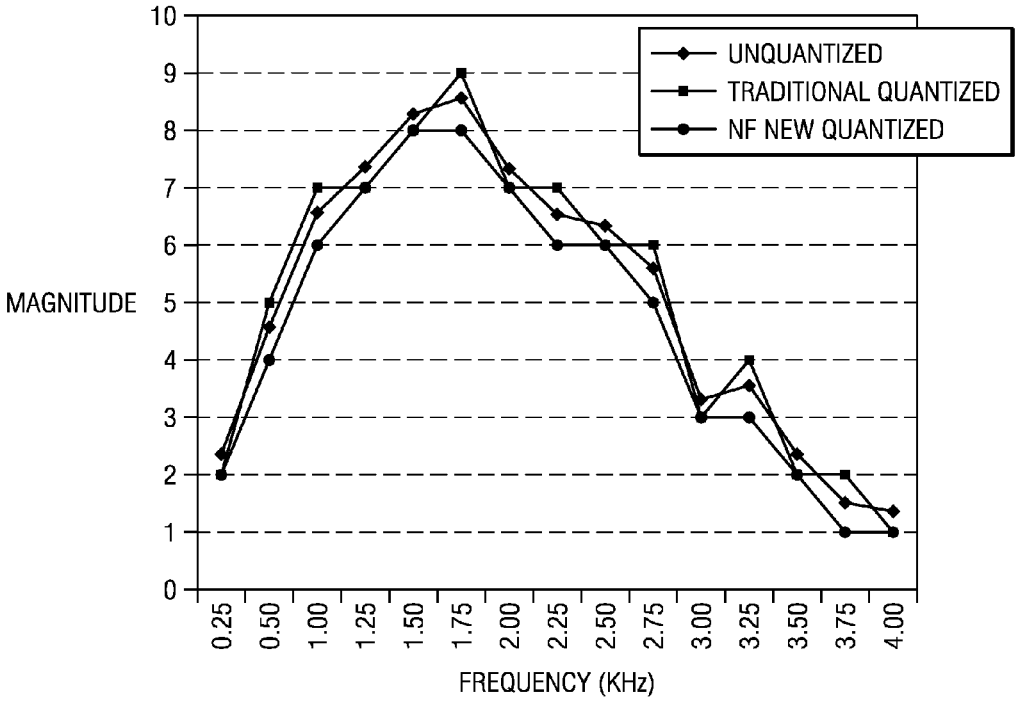
FIG. 8 illustrates an example of an improved spectral shape with Noise-Feedback quantization.
Figure 9:
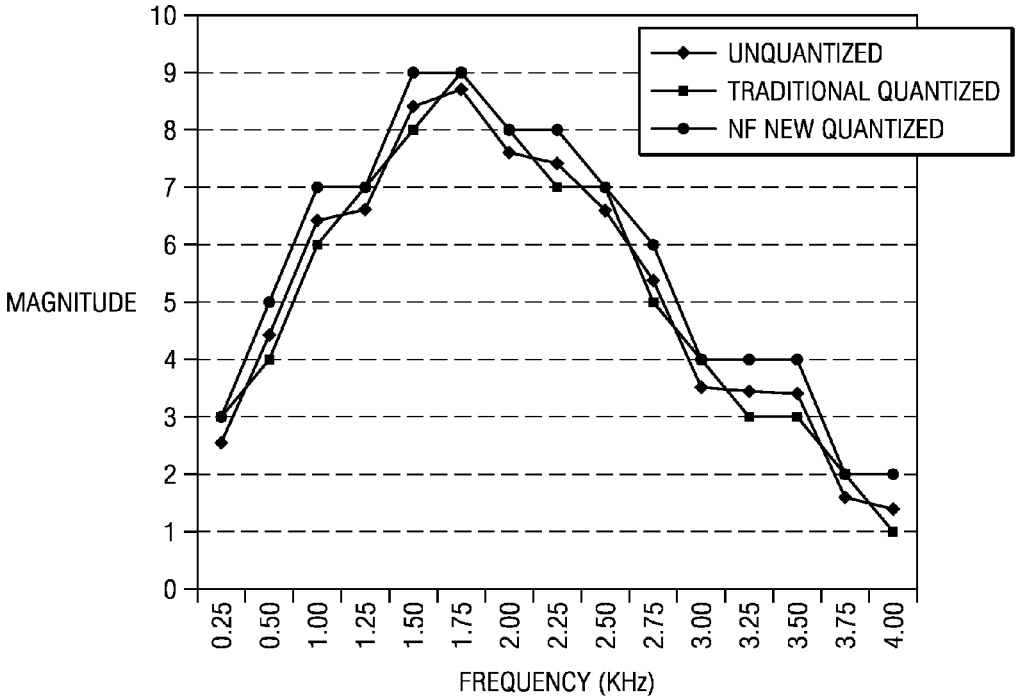
FIG. 9 illustrates another example of an improved spectral shape with Noise-Feedback quantization.

The best $F_m$ would be:

$$F_m = \frac{\sum_i M(i) \cdot M_{q2}(i)}{\sum_i M_{q2}(i) \cdot M_{q2}(i)}, \tag{19}$$

where $F_m$ may be a value close to 1, and may be quantized with very few bits. If the spectral envelope coding is followed by temporal envelope coding, any small correction is not necessary since the temporal envelope coding could take care of it. If the constant $\alpha$ in (15) is small, the energy compensation is not needed. The two examples in FIG. 8 and FIG. 9 have shown $M_{q2}(i)$ without adding energy compensation to have a clear view.

The following shows another more detailed example. A super wideband codec uses ITU-T G.729.1/G.718 codecs as the core layers to code [0, 7 kHz]. The super wideband portion of [7 kHz, 14 kHz] is extended/coded in MDCT domain. [14 kHz, 16 kHz] is set to zero. [0, 7 kHz] and [7 kHz, 14 kHz] correspond to 280 MDCT coefficients respectively, which are {MDCT(0), MDCT(1), . . . , MDCT(279)} and {MDCT(280), MDCT(281), . . . , MDCT(559)}. Suppose [0, 7 kHz] is already coded by the core layers and [7kHz, 11kHz] is coded by a low bit rate frequency prediction approach, which makes use of the MDCT coefficients from [0, 7 kHz] to predict the MDCT coefficients of [7 kHz, 11 kHz], the spectral fine structure of [11 kHz, 14 kHz] that is {MDCT(440), MDCT(441), . . . , MDCT(559)} is simply copied from {MDCT(20), MDCT(21), . . . , MDCT(139)}. The spectral envelope on [11 kHz, 14 kHz] will be encoded/quantized with the Noise-Feedback solution. First, [11 kHz, 14 kHz] is divided into 4 subbands, with each subband containing 30 MDCT coefficients. The unquantized spectral magnitudes (spectral envelope) for each subband may be defined in Log domain as, $$\log \text{Gain}(i) = 4 \cdot \log_{10}\left(\text{gain_factor} \cdot \sum_k MDCT(k)^2 / 30\right), \quad i = 0, 1, 2, 3; \tag{20}$$

where gain_factor is just a correction factor for adjusting the relative relationship between [7 kHz, 11 kHz] and [7 kHz, 11 kHz]. The maximum value among these 4 values is $$\text{maxVal} = \text{Max}\{\log \text{Gains}(i), i=0, 1, 2, 3\} \tag{21}$$

where maxVal is quantized with 5 bits and sent to decoder. Then, each spectral magnitude is quantized with relative to maxVal, which means the difference $$M(i) = \text{maxVal} - \log \text{Gains}(i), i=0, 1, 2, 3 \tag{22}$$

will be quantized instead of the direct quantization of log Gains(i). The quantization step for the scalar quantization of the differences {M(i), i=0, 1, 2, 3} is set to, $$\text{Step} = \text{maxVal}/4 \tag{23}$$

If Step>1.2, Step is set to 1.2. The quantized differences of {M(i), i=0, 1, 2, 3} are $$M_{q2}(i) = \text{Index}(i) \cdot \text{Step}, i=0, 1, 2, 3; \tag{24}$$

Index(i) for each subband will be sent to decoder. During the searching of best Index(i) from i=0 to i=3, when i=0, the first one M(0) is directly quantized by minimizing $|M_{q2}(\mathbf{0}) - M(\mathbf{0})$. The error is noted as $Er(\mathbf{0}) = M_{q2}(\mathbf{0}) - M(\mathbf{0})$. For i>0, the quantization error is expressed as $Er(i) = M_{q2}(i) - M(i)$. Suppose the previous one at (i−1) is already quantized and the known quantization error is $Er(i-1) = M_{q2}(i-1) - M(i-1)$, During the current quantization of M(i), the error minimization criteria can be modified to minimize the following express, $$\text{MIN}\{|M_{q2}(i) - M(i) - \alpha \cdot Er(i-1)|\} \tag{25}$$

where $\alpha$ is a constant which is set to $\alpha=0.5$. At the decoder side, the inverse operation of the quantization process in encoder is performed to get the desired spectrum envelope.

In the above description, a method of quantizing a spectral envelope having a plurality of spectral magnitudes of spectral subbands by using the Noise-Feedback solution is provided. The method may comprise the steps of: quantizing spectral magnitudes one by one in scalar quantization; feeding back quantization error of previous magnitude to influence quantization of current magnitude by adaptively modifying the quantization criterion; and minimizing current quantization error by using the modified quantization criterion. The scalar quantization can be a usual direct scalar quantization or an indirect scalar quantization such as differential coding or Huffman coding in Log domain or Linear domain. Overall energy or average magnitude of the quantized spectral envelope can be adjusted or normalized in time domain or frequency domain when necessary.

Figure 10:
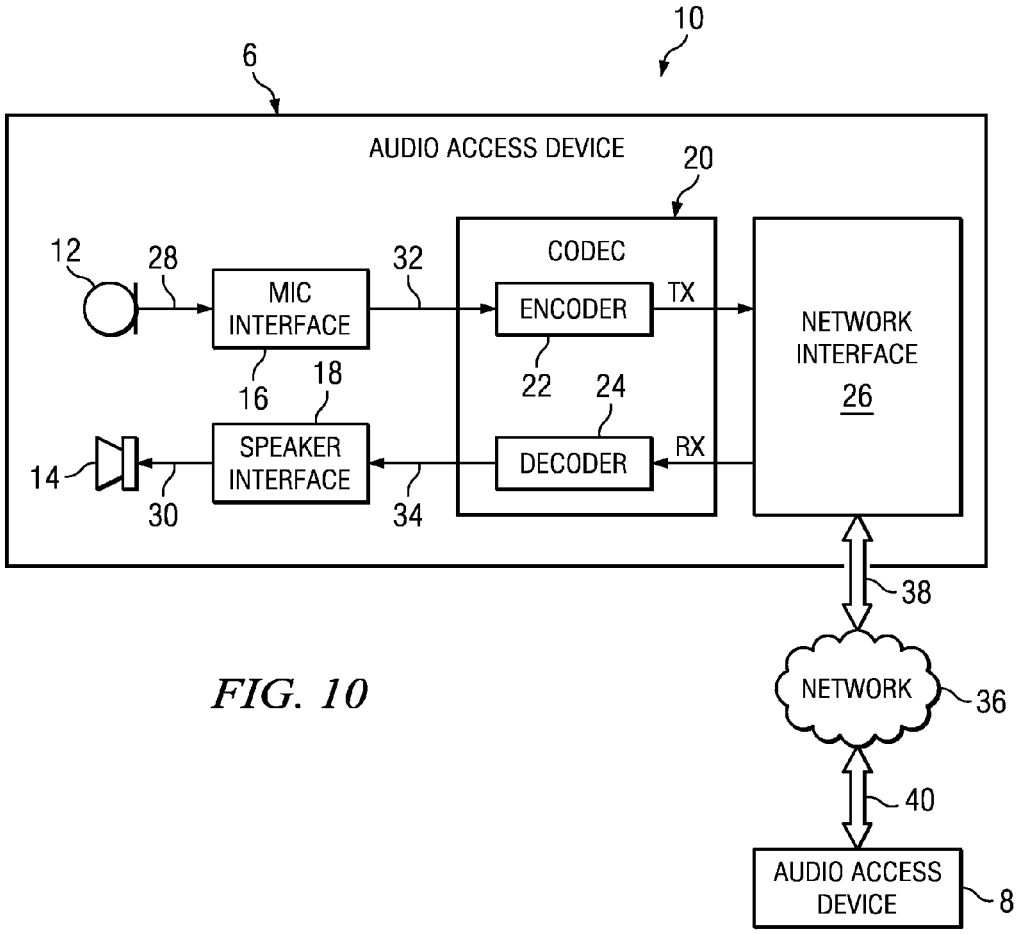
FIG. 10 illustrates a communication system according to an embodiment of the present invention.

FIG. 10 illustrates communication system 10 according to an embodiment of the present invention. Communication system 10 has audio access devices 6 and 8 coupled to network 36 via communication links 38 and 40. In one embodiment, audio access device 6 and 8 are voice over internet protocol (VOIP) devices and network 36 is a wide area network (WAN), public switched telephone network (PTSN) and/or the internet. Communication links 38 and 40 are wireline and/or wireless broadband connections. In an alternative embodiment, audio access devices 6 and 8 are cellular or mobile telephones, links 38 and 40 are wireless mobile telephone channels and network 36 represents a mobile telephone network.

Audio access device 6 uses microphone 12 to convert sound, such as music or a person's voice into analog audio input signal 28. Microphone interface 16 converts analog audio input signal 28 into digital audio signal 32 for input into encoder 22 of CODEC 20. Encoder 22 produces encoded audio signal TX for transmission to network 26 via network interface 26 according to embodiments of the present invention. Decoder 24 within CODEC 20 receives encoded audio signal RX from network 36 via network interface 26, and converts encoded audio signal RX into digital audio signal 34. Speaker interface 18 converts digital audio signal 34 into audio signal 30 suitable for driving loudspeaker 14.

In an embodiment of the present invention, where audio access device 6 is a VOIP device, some or all of the components within audio access device 6 are implemented within a handset. In some embodiments, however, Microphone 12 and loudspeaker 14 are separate units, and microphone interface 16, speaker interface 18, CODEC 20 and network interface 26 are implemented within a personal computer. CODEC 20 can be implemented in either software running on a computer or a dedicated processor, or by dedicated hardware, for example, on an application specific integrated circuit (ASIC). Microphone interface 16 is implemented by an analog-to-digital (A/D) converter, as well as other interface circuitry located within the handset and/or within the computer. Likewise, speaker interface 18 is implemented by a digital-to-analog converter and other interface circuitry located within the handset and/or within the computer. In further embodiments, audio access device 6 can be implemented and partitioned in other ways known in the art.

In embodiments of the present invention where audio access device 6 is a cellular or mobile telephone, the elements within audio access device 6 are implemented within a cellular handset. CODEC 20 is implemented by software running on a processor within the handset or by dedicated hardware. In further embodiments of the present invention, audio access device may be implemented in other devices such as peer-to-peer wireline and wireless digital communication systems, such as intercoms, and radio handsets. In applications such as consumer audio devices, audio access device may contain a CODEC with only encoder 22 or decoder 24, for example, in a digital microphone system or music playback device. In other embodiments of the present invention, CODEC 20 can be used without microphone 12 and speaker 14, for example, in cellular base stations that access the PTSN.

The above description contains specific information pertaining to the scalar quantization of spectral envelope with the Noise-Feedback quantization technology. However, one skilled in the art will recognize that the present invention may be practiced in conjunction with various encoding/decoding algorithms different from those specifically discussed in the present application. Moreover, some of the specific details, which are within the knowledge of a person of ordinary skill in the art, are not discussed to avoid obscuring the present invention.

The drawings in the present application and their accompanying detailed description are directed to merely example embodiments of the invention. To maintain brevity, other embodiments of the invention that use the principles of the present invention are not specifically described and are not specifically illustrated by the present drawings.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A method of transmitting an input audio signal, the method comprising:

quantizing a current spectral magnitude of the input audio signal;

feeding back a quantization error of a previous spectral magnitude to influence quantization of the current spectral magnitude, wherein feeding back comprises adaptively modifying a quantization criterion to form a modified quantization criterion;

minimizing a current quantization error by using the modified quantization criterion;

forming a quantized spectral envelope based on the minimizing, wherein the steps of quantizing, feeding back, minimizing and forming are performed using a hardware-based audio coder; and transmitting the quantized spectral envelope.

2. The method of claim 1, wherein minimizing further comprises using a noise-feedback solution.

3. The method of claim 1, wherein quantizing the spectral magnitudes comprises performing a scalar quantization.

4. The method of claim 3, wherein the scalar quantization comprises a direct scalar quantization.

5. The method of claim 3, wherein the scalar quantization comprises an indirect scalar quantization.

6. The method of claim 5, wherein:

the indirect scalar quantization comprises differential coding or Huffman coding; and the quantization is performed in a log domain or a linear domain.

7. The method of claim 1, further comprising:

setting an initial quantization error of the current spectral magnitude to be $Er(i)=M_{q2}(i)-M(i)$, where $M(i)$ is a current reference magnitude and $M_{q2}(i)$ is a current quantized magnitude; and setting an initial quantization error of a previous magnitude as $Er(i-1)=M_{q2}(i-1)-M(i-1)$, where $M(i-1)$ is a previous reference magnitude and $M_{q2}(i-1)$ is a previous quantized magnitude.

8. The method of claim 7, further comprising setting the current reference magnitude to be $M(i)=maxVal-\log Gains(i)$, where maxVal is a maximum spectral magnitude and log Gains(i) is a spectral magnitude in a log domain.

9. The method of claim 7, wherein quantizing the current spectral magnitude comprises setting $M_{q2}(i)=Index(i)\cdot Step$, where Index(i) is a quantization index for each magnitude and Step is defined as $Step=maxVal/4$, where if $Step>1.2$, $Step=1.2$, and maxVal is a maximum spectral magnitude.

10. The method of claim 1, wherein minimizing the current quantization error comprises minimizing the expression $MIN\{|M_{q2}(\mathbf{0})-M(\mathbf{0})|\}$, where $M(\mathbf{0})$ is a first reference magnitude and $M_{q2}(\mathbf{0})$ is said first quantized magnitude.

11. The method of claim 1, wherein minimizing the current quantization error comprises minimizing the expression $MIN\{|M_{q2}(i)-M(i)-\alpha\cdot Er(i-1)|\}$, where $M(i)$ is a current reference magnitude, $M_{q2}(i)$ is said current quantized magnitude, $Er(i-1)$ is a quantization error of a previous magnitude, and $\alpha$ is a constant ($0<\alpha<1$) to control how much error noise is fed back from the quantization error $Er(i-1)$ of the previous spectral magnitude.

12. The method of claim 11, wherein an overall energy of the quantized spectral envelope is not adjusted or normalized if $\alpha<=0.5$.

13. The method of claim 11, wherein $\alpha$ is about 0.5.

14. The method of claim 1, further comprising normalizing an average magnitude of a quantized spectral envelope of the input audio signal in a time domain or a frequency domain.

15. The method of claim 1, further comprising:

receiving the quantized spectral envelope; and forming an output audio signal based on the quantized spectral envelope.

16. The method of claim 15, further comprising driving a loudspeaker with the output audio signal.

17. The method of claim 1, wherein transmitting comprises transmitting over a voice over internet protocol (VOIP) network.

18. The method of claim 1, wherein transmitting comprises transmitting over a cellular telephone network.

19. The method of claim 1, wherein using the hardware-based audio coder comprises performing the steps of quantizing, feeding back, minimizing and forming using a processor.

20. The method of claim 1, wherein using the hardware-based audio coder comprises performing the steps of quantizing, feeding back, minimizing and forming using dedicated hardware.

21. A system for transmitting an input audio signal, the system comprising:

a transmitter comprising a hardware-based audio coder, the hardware-based audio coder configured to quantize a current spectral magnitude of the input audio signal;

feed back a quantization error of a previous spectral magnitude to influence quantization of the current spectral magnitude, wherein feeding back comprises adaptively modifying a quantization criterion to form a modified quantization criterion;

minimize a current quantization error by using the modified quantization criterion; and form a quantized spectral envelope based on minimizing the current quantization error.

22. The system of claim 21, wherein the system is configured to operate over a voice over internet protocol (VOIP) system.

23. The system of claim 21, wherein the system is configured to operate over a cellular telephone network.

24. The system of claim 21, further comprising a receiver, the receiver comprising an audio decoder configured to receive the quantized spectral envelope and produce an output audio signal based on the quantized spectral envelope.

25. The system of claim 21, wherein the hardware-based audio coder comprises a processor.

26. The system of claim 21, wherein the hardware-based audio coder comprises dedicated hardware.

* * * * *